US010714821B2

(12) United States Patent
Chiu

(10) Patent No.: US 10,714,821 B2
(45) Date of Patent: Jul. 14, 2020

(54) ANTENNA STRUCTURE

(71) Applicant: GETAC TECHNOLOGY CORPORATION, Hsinchu County (TW)

(72) Inventor: Shang-Ming Chiu, New Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 710 days.

(21) Appl. No.: 14/800,719

(22) Filed: Jul. 16, 2015

(65) Prior Publication Data

US 2017/0018846 A1 Jan. 19, 2017

(51) Int. Cl.
*H01Q 1/36* (2006.01)

(52) U.S. Cl.
CPC ..... *H01Q 1/362* (2013.01)

(58) Field of Classification Search
CPC ..... H01Q 11/08; H01Q 1/362; H01Q 9/27; H01Q 1/243; H01Q 9/42; H01Q 9/16; H01Q 9/30; H01Q 5/357; H01Q 1/288; H01Q 1/42; H01Q 5/335; H01Q 13/08; H01Q 19/108; H01Q 9/28
USPC ..... 343/895, 756, 833, 834, 909
See application file for complete search history.

(56) References Cited

U.S. PATENT DOCUMENTS 5,612,707 A * 3/1997 Vaughan ..... H01Q 3/01 343/895
6,054,966 A * 4/2000 Haapala ..... H01Q 1/242 343/749
6,169,523 B1 * 1/2001 Ploussios ..... H01O 1/36 343/802
6,181,286 B1 * 1/2001 Roscoe ..... H01Q 1/362 343/702
6,448,934 B1 * 9/2002 Lee ..... H01Q 1/242 343/702
6,559,811 B1 * 5/2003 Pulimi ..... H01O 1/242 343/702
6,720,935 B2 * 4/2004 Lamensdorf ..... H01Q 1/362 343/700 MS
6,906,683 B2 * 6/2005 Ikeda ..... H01Q 9/32 343/756
6,987,494 B2 * 1/2006 Keren ..... H01O 1/36 343/702
7,158,819 B1 * 1/2007 Pulimi ..... H01Q 1/362 343/702
7,262,738 B2 * 8/2007 Ho ..... H01Q 1/362 343/702
7,375,626 B2 * 5/2008 Ening ..... G06K 7/10336 340/447

(Continued)

*Primary Examiner* — Linh V Nguyen

(57) ABSTRACT

An antenna structure includes a central grounding line and a spiral antenna. The central grounding line is linear and has two end portions provided with a grounding point and a first open point, respectively. The spiral antenna has two end portions provided with a feeding point and a second open point, respectively. The spiral antenna winds around the central grounding line while extending in the direction from the grounding point to the first open point, with the second open point positioned proximate to the first open point, wherein the spiral antenna and the central grounding line are spaced apart by an axial distance, thereby allowing the antenna structure to receive and transmit a radio frequency signal with circular polarization.

15 Claims, 2 Drawing Sheets

(56) References Cited

U.S. PATENT DOCUMENTS

| | | | | |
|---|---|---|---|---|
| 2006/0290590 | A1* | 12/2006 | Takaoka | H01O 11/08<br>343/895 |
| 2007/0200786 | A1* | 8/2007 | Takaoka | H01O 1/32<br>343/895 |
| 2015/0171517 | A1* | 6/2015 | Grandfield | H01Q 3/28<br>342/368 |

* cited by examiner

ANTENNA STRUCTURE

BACKGROUND OF THE INVENTION

Field of the Invention

The present invention relates to antenna structures and more particularly to an antenna structure adapted to receive and transmit a radio frequency signal with circular polarization.

Description of the Prior Art

In general, wireless radio frequency signals are capable of exhibiting characteristics of linear polarization or circular polarization and therefore are designed to do so as needed. For example, according to the specifications of global positioning systems (GPS), all electromagnetic waves for use in defining a GPS-oriented positioning signal usually exhibit circular polarization characteristics. To receive a positioning signal with circular polarization characteristics, an antenna disposed at a receiving end for the positioning signal is a patch antenna or ceramic antenna for receiving a radio frequency signal with circular polarization characteristics to thereby ensure that the positioning signal can be well received during its transceiving process.

The aforesaid two antennas exhibit satisfactory circular polarization characteristics and therefore are applicable to GPS. However, the aforesaid two antennas will have an insatiable demand for bandwidth if the positioning signal received by them is also for use in a global navigation satellite system (GNSS). Furthermore, ceramic antennas are time-consuming and intricate to manufacture and difficult to modify when designed; as a result, their receiving and transmitting frequencies cannot be readily fine-tuned. As electronic devices nowadays show a trend toward being lightweight, thin and compact, antenna structure designers have to give considerations to the volume of an antenna, space to be taken up by the antenna, circular polarization characteristics and applicable systems.

SUMMARY OF THE INVENTION

The present invention provides an antenna structure adapted to receive and transmit a radio frequency signal with circular polarization and increase the bandwidth for receiving and transmitting signals.

The antenna structure of the present invention comprises a central grounding line and a spiral antenna. The central grounding line is linear and has two end portions provided with a grounding point and a first open point, respectively. The spiral antenna has two end portions provided with a feeding point and a second open point, respectively. The spiral antenna winds around the central grounding line while extending in the direction from the grounding point to the first open point, with the second open point positioned proximate to the first open point, wherein the spiral antenna and the central grounding line are spaced apart by an axial distance, thereby allowing the antenna structure to receive and transmit a radio frequency signal with circular polarization.

In an embodiment of the present invention, a total length of the central grounding line equals a quarter wavelength of the radio frequency signal with circular polarization.

In an embodiment of the present invention, a total length of the spiral antenna equals a wavelength of a radio frequency signal with circular polarization.

In an embodiment of the present invention, a distance between the grounding point and the first open point of the central grounding line substantially equals a distance between the feeding point and the second open point of the spiral antenna.

In an embodiment of the present invention, a polarization direction of the radio frequency signal with circular polarization runs parallel to the central grounding line and extends from the grounding point to the first open point.

In an embodiment of the present invention, the grounding point connects with a system ground plane, wherein the antenna structure is adapted to receive a radio frequency signal from a radio frequency signal transmission unit and enable the radio frequency signal to undergo resonance through a current path which begins at the feeding point and ends between the second open point and the first open point to thereby send the radio frequency signal with circular polarization.

In an embodiment of the present invention, the axial distance between the spiral antenna and the central grounding line is directly proportional to a Q-factor (Quality factor) of the radio frequency signal with circular polarization.

Therefore, the antenna structure of the present invention comprises a central grounding line and a spiral antenna. The central grounding line is linear and has two end portions provided with a grounding point and a first open point, respectively. The spiral antenna has two end portions provided with a feeding point and a second open point, respectively. The spiral antenna winds around the central grounding line while extending in the direction from the grounding point to the first open point, with the second open point positioned proximate to the first open point, wherein the spiral antenna and the central grounding line are spaced apart by an axial distance. Therefore, the antenna structure of the present invention is adapted to not only receive and transmit a radio frequency signal with circular polarization but also increase the bandwidth of the circularly polarized radio frequency signal received and transmitted.

To render the aforesaid features and advantages of the present invention more remarkable and comprehensible, the present invention is hereunder illustrated with an embodiment and drawings and described below.

DETAILED DESCRIPTION OF THE EMBODIMENTS

Figure 1:
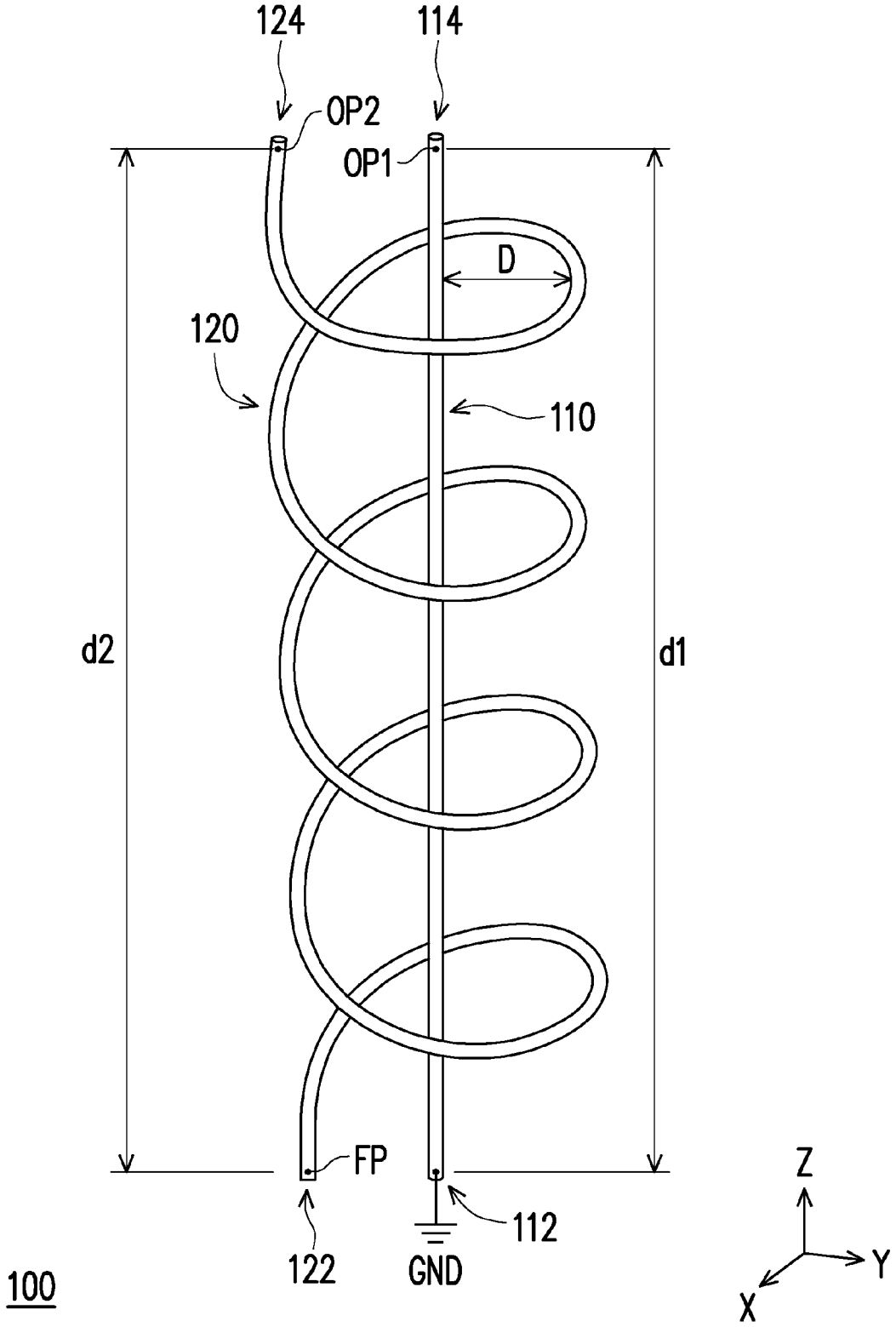
FIG. 1 is a schematic view of an antenna structure according to an embodiment of the present invention.
Figure 2:
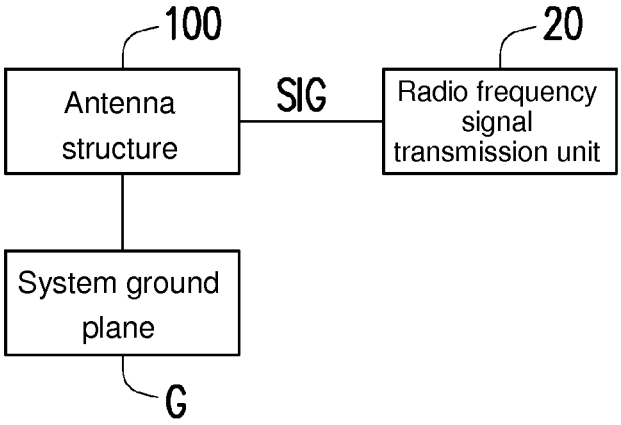
FIG. 2 is a function block diagram of the antenna structure shown in FIG.

FIG. 1 is a schematic view of an antenna structure according to an embodiment of the present invention. FIG. 2 is a function block diagram of the antenna structure shown in FIG. 1. Referring to FIG. 1 and FIG. 2, in this embodiment, an antenna structure 100 comprises a central grounding line 110 and a spiral antenna 120. The central grounding line 110 is linear and has two end portions 112, 114 provided with a grounding point GND and a first open point OP1, respectively. The spiral antenna 120 has two end portions 122, 124 provided with a feeding point FP and a second open point OP2, respectively. The spiral antenna 120 winds around the central grounding line 110 while extending in the direction from the grounding point GND to the first open point OP1 of the central grounding line 110. The second open point OP2 is positioned proximate to the first open point OP1. The spiral antenna 120 and the central grounding line 110 are spaced apart by an axial distance D. Therefore, the antenna structure 100 can be disposed at an electronic device (not shown) and thereby receive and transmit a circularly polarized radio frequency signal SIG (shown in FIG. 2).

Specifically speaking, in this embodiment, the central grounding line 110 is linear and made of a non-ceramic material, preferably a metal or any other appropriate material, but the present invention is not limited thereto. The spiral antenna 120 is spiral and made of a non-ceramic material, preferably a metal or any other appropriate material, but the present invention is not limited thereto. The positional relationship between the central grounding line 110 and the spiral antenna 120 is as follows: the spiral antenna 120 winds around the linear central grounding line 110.

In this embodiment, the spiral antenna 120 winds around the central grounding line 110 while extending in the direction from the end portion 122 provided with the feeding point FP to the end portion 124 provided with the second open point OP2; that is, in the direction from the grounding point GND to the first open point OP1. Therefore, the feeding point FP of the spiral antenna 120 is adjacent to the grounding point GND of the central grounding line 110, and the second open point OP2 of the spiral antenna 120 is adjacent to the first open point OP1 of the central grounding line 110. The spiral antenna 120 does not come into contact with the central grounding line 110 while winding around the central grounding line 110. The spiral antenna 120 and the central grounding line 110 are spaced apart by the axial distance D.

Furthermore, in this embodiment, the total length of the central grounding line 110 equals a quarter wavelength of the radio frequency signal SIG with circular polarization, and the total length of the spiral antenna 120 equals the wavelength of the radio frequency signal SIG with circular polarization. After the spiral antenna 120 has wound around the central grounding line 110, distance d1 between the first open point OP1 and the grounding point GND of the central grounding line 110 equals distance d2 between the second open point OP2 and the feeding point FP of the spiral antenna 120. Alternatively, although the total length of the spiral antenna 120 (which equals the wavelength of the radio frequency signal SIG with circular polarization) is larger than the total length of the central grounding line 110 (which equals a quarter wavelength of the radio frequency signal SIG with circular polarization), the height of the central grounding line 110 (which equals the aforesaid distance d1) substantially equals the height of the spiral antenna 120 (which equals the aforesaid distance d2) after the spiral antenna 120 has wound around the central grounding line 110.

Due to the aforesaid design, the antenna structure 100 is adapted to receive and transmit the radio frequency signal SIG with circular polarization. Referring to FIG. 2, in this embodiment, the antenna structure 100 connects with a system ground plane G and receives the radio frequency signal SIG from a radio frequency signal transmission unit 20. The antenna structure 100 connects with the system ground plane G through the grounding point GND. The radio frequency signal SIG, which is received by the antenna structure 100 from the radio frequency signal transmission unit 20, undergoes resonance through a current path which begins at the feeding point FP and ends between the second open point OP2 and the first open point OP1 to thereby send the radio frequency signal SIG with circular polarization. Therefore, the polarization direction of the radio frequency signal SIG with circular polarization parallels to the central grounding line 110 and extends from the grounding point GND to the first open point OP1.

More specifically, in this embodiment, the antenna structure 100 has two current paths, namely one from the feeding point FP to the second open point OP2 and the other from the feeding point FP to the first open point OP1. With the spiral antenna 120 winding around the central grounding line 110, the radio frequency signal SIG, which is received by the antenna structure 100 from the radio frequency signal transmission unit 20, undergoes resonance through a current path extending from the feeding point FP to the second open point OP2 relative to a current path extending from the feeding point FP to the first open point OP1 to thereby generate a current and convert into the radio frequency signal SIG with circular polarization. The polarization direction of the radio frequency signal SIG with circular polarization runs parallel to the central grounding line 110 and extends from the grounding point GND to the first open point OP1. Therefore, a phase difference of 90 degrees is generated between the two current paths of the antenna structure 100 such that the antenna structure 100 receives and transmits the radio frequency signal SIG with circular polarization in z-direction (shown in FIG. 1).

A phase difference of 90 degrees generated between the two current paths of the antenna structure 100 ensures that the circular polarization characteristics of the circularly polarized radio frequency signal SIG received and transmitted are attributed to left hand circular polarization (LHCP) or right hand circular polarization (RHCP). Electric fields Ex, Ey, Ez and total electric field E of the radio frequency signal received and transmitted by a typical antenna structure in x, y, z-directions of a spatial coordinate system conform with equations as follows:

$$Ex = Ey = Ez$$

$$\vec{Ex}(z, t) = \vec{i}E0\ \cos(kz - \omega t)$$

$$\vec{Ey}(z, t) = \vec{j}E0\ \sin(kz - \omega t)$$

$$\vec{E}(z, t) = E0\left(\vec{i}\ \cos(kz - \omega t) - \vec{j}\ \sin(kz - \omega t)\right)$$

$$kz = \frac{\pi}{4},\ \omega = \pm 2n\pi - \frac{\pi}{2},\ n = 0, 1, 2, \ldots$$

Unlike a conventional antenna structure, the antenna structure 100 of the present invention is further characterized in that the central grounding line 110 is disposed in the midst of the spiral antenna 120, and therefore the electric fields of the radio frequency signal SIG received and transmitted by it in x, y, z-directions of a spatial coordinate system conform with equations as follows:

$$Ex = Ey = E0 - Ez$$

$$\vec{Ex}(z, t) = \vec{i}E0\ \cos(kz - \omega t)$$

$$\vec{Ey}(z, t) = \vec{j}E0\ \sin(kz - \omega t)$$

$$\vec{Ez}(z, t) = \vec{h}K0E0$$

$$\vec{E}(z, t) = E0\left(\vec{i}\ \cos(kz - \omega t) - \vec{j}\ \sin(kz - \omega t)\right) + \vec{h}k0E0$$

$$kz = \frac{\pi}{4},\ \omega = \pm 2n\pi - \frac{\pi}{2},\ n = 0, 1, 2, \ldots$$

where k0 denotes the coupling constant of the spiral antenna 120 and the central grounding line 110. Therefore, the electric field of the antenna structure 100 produces a component in z-direction, and the component depends on the diameter (or the axial distance D) of the antenna structure 100.

When the antenna structure 100 is for use in receiving and transmitting the radio frequency signal SIG, there is a phase difference of 90 degrees between electric field Ex component produced in x-direction and electric field Ey component produced in y-direction of a spatial coordinate system by the radio frequency signal SIG. Therefore, the antenna structure 100 is adapted to send the radio frequency signal SIG with circular polarization. Furthermore, according to the above equations, in this embodiment, the central grounding line 110 is disposed in the midst of the spiral antenna 120 such that the antenna structure 100 manifests electric field Ez component in z-direction. Therefore, the antenna pattern of the radio frequency signal SIG emitted from the antenna structure 100 tends to concentrate in z-direction to enable the antenna structure 100 to exhibit satisfactory directivity. In addition, the present invention entails grounding the central grounding line 110 and feeding a current to the spiral antenna 120 at one end to increase the magnetic flux of the antenna structure 100 and thereby enable the antenna structure 100 to exhibit satisfactory antenna matching. Therefore, the antenna structure 100 of the present invention is adapted to receive and transmit the radio frequency signal SIG with circular polarization, manifest satisfactory directivity, and increase the axial distance D to thereby increase the bandwidth of the radio frequency signal SIG, thus augmenting the energy of the radio frequency signal SIG with circular polarization.

In this embodiment, results of measurement performed with different antenna structures but identical parameters (for example, the antenna structure 100 has a diameter (i.e., two times the axial distance D) of 0.01 meter, and both the spiral antenna 120 and the central grounding line 110 have a radius of 0.001 meter, parameter c of 0.031415927 meter, the spiral antenna 120 has a pitch of 0.004 meter, the spiral antenna 120 has a pitch angle of 0.126642538 degree, the antenna structure 100 has a length of 0.031669551 meter, light speed of $3\times10^8$ m/s, and wave speed of 38197186.34 m/s, and so forth) are shown in the table below.

| | Number of windings of spiral antenna | | | |
|---|---|---|---|---|
| | 4 | 3 | 2 | 1.75 |
| Length (meter) of spiral antenna | 0.1267 | 0.0950 | 0.0633 | 0.0554 |
| Length (meter) of central grounding line | 0.015 | 0.01 | 0.005 | 0.0038 |
| Center frequency (GHz) | 0.729 | 0.895 | 1.222 | 1.575 |
| Wavelength (meter) | 0.0524 | 0.0427 | 0.0313 | 0.0243 |
| Quarter wavelength (meter) | 0.0131 | 0.0107 | 0.0078 | 0.0061 |

Therefore, in the antenna structure 100, the center frequency and wavelength of the circularly polarized radio frequency signal SIG received and transmitted by the antenna structure 100 depend on the length of the central grounding line 110, the length of the spiral antenna 120, and the number of windings of the spiral antenna 120 around the central grounding line 110.

In addition, the axial distance D between the spiral antenna 120 and the central grounding line 110 correlates with the Q-factor (i.e., Q value) of the circularly polarized radio frequency signal SIG received and transmitted by the antenna structure 100 and thus is useful in adjusting the Q-factor of the circularly polarized radio frequency signal SIG. The results of measurement performed with different antenna structures but with identical parameters (for example, the spiral antenna 120 has a pitch of 0.0015 meter, and both the spiral antenna 120 and the central grounding line 110 have a radius of 0.0005 meter) are shown in the table below.

| | Sample | | |
|---|---|---|---|
| | 1 | 2 | 3 |
| Number of windings of spiral antenna | 1.75 | 1.45 | 1.25 |
| Diameter (i.e., two times the axial distance) (meter) | 0.008 | 0.01 | 0.012 |
| Parameter c (meter) | 0.0251 | 0.0314 | 0.0377 |
| Length (meter) of antenna structure | 0.0252 | 0.0315 | 0.0377 |
| Pitch angle (degree) of spiral antenna | 0.0596 | 0.0477 | 0.0398 |
| Length (meter) of spiral antenna | 0.0441 | 0.0456 | 0.0472 |
| Length (meter) of central grounding line | 0.0015 | 0.0009 | 0.0005 |
| First frequency (GHz) | 1.7316 | 1.7226 | 1.7015 |
| Second frequency (GHz) | 1.3970 | 1.4030 | 1.4151 |
| Bandwidth (GHz) | 0.3347 | 0.3196 | 0.2864 |
| Center frequency (GHz) | 1.585 | 1.585 | 1.585 |
| Q-factor | 4.736 | 4.959 | 5.534 |

wherein the bandwidth of the antenna structure 100 equals the difference between the first frequency and the second frequency, and the center frequency equals the average of the first frequency and the second frequency, whereas the Q-factor equals the ratio of the center frequency to the bandwidth. As indicated by the table above, the diameter (i.e., two times the axial distance D) between the spiral antenna 120 and the central grounding line 110 increases gradually from sample 1 to simple 2 and then to simple 3, and the Q-factor of the radio frequency signal SIG with circular polarization increases gradually from sample 1 to simple 2 and then to simple 3, showing that the axial distance D (i.e., a half of the diameter) between the spiral antenna 120 and the central grounding line 110 correlates with the Q-factor of the radio frequency signal SIG with circular polarization. In practice, the axial distance D between the spiral antenna 120 and the central grounding line 110 is directly proportional to the Q-factor of the radio frequency signal SIG with circular polarization. Therefore, by adjusting the axial distance D between the spiral antenna 120 and the central grounding line 110 (or adjusting the diameter of the antenna structure 100). For example, it is practicable to reduce the axial distance D between the spiral antenna 120 and the central grounding line 110 and therefore conducive to the reduction in the Q-factor of the circularly polarized radio frequency signal SIG received and transmitted by the antenna structure 100, thereby increasing the bandwidth.

The results of a comparison between the antenna structure 100 in this embodiment and a conventional ceramic antenna are as follows: under the same parameter condition (for example, with a center frequency of 1.585 GHz), the circularly polarized radio frequency signal received and transmitted by the conventional ceramic antenna has a bandwidth of 0.038 GHz (with the first frequency of 1.608 GHz and the second frequency of 1.57 GHz) and a Q-factor (equal to the ratio of the center frequency to the bandwidth) of 41.71. By contrast, the circularly polarized radio frequency signal SIG received and transmitted by the antenna structure 100 in this embodiment has bandwidths of 0.334665 GHz in sample 1, 0.31959 GHz in sample 2, and 0.286425 GHz in sample 3, respectively, and Q factors (equal to the ratio of the center frequency to the bandwidth) of 4.736 in sample 1, 4.959 in sample 2, and 5.534 in sample 3, respectively. Therefore, the inadequacy of the bandwidth of the conventional ceramic antenna brings about the overly large Q-factor thereof. As a result, the conventional ceramic antenna fails to receive and transmit triple-frequency signals and is even ineffective in receiving and transmitting dual-frequency signals. The aforesaid triple-frequency signals are exemplified by Bei-Dou satellite signals (with a bandwidth of 1.561 GHz), global positioning system (GPS) signals (with a bandwidth of 1.575 GHz), and global navigation satellite system (GLONASS) signals (with a bandwidth of 1.592 to 1.610 GHz and a center frequency of 1.602 GHz). By contrast, the Q-factor of the antenna structure 100 in this embodiment is less than the Q-factor of the conventional ceramic antenna by one-tenth approximately. With the Q-factor being equal to the ratio of the center frequency to the bandwidth, given the same center frequency, a reduction in the Q-factor brings about a larger bandwidth. Therefore, the antenna structure 100 with the aforesaid design is adapted to not only receive and transmit the radio frequency signal SIG with circular polarization but also increase the bandwidth of the circularly polarized radio frequency signal SIG received and transmitted (i.e., achieving broadband), thereby enhancing the efficiency of receiving and transmitting the circularly polarized radio frequency signal SIG.

In conclusion, an antenna structure of the present invention comprises a central grounding line and a spiral antenna. The central grounding line is linear and has two end portions provided with a grounding point and a first open point, respectively. The spiral antenna has two end portions provided with a feeding point and a second open point, respectively. The spiral antenna winds around the central grounding line while extending in the direction from the grounding point to the first open point, with the second open point positioned proximate to the first open point, wherein the spiral antenna and the central grounding line are spaced apart by an axial distance. Due to the aforesaid design of the spiral antenna, the antenna structure is adapted to receive and transmit a radio frequency signal with circular polarization. Due to the aforesaid design of the central grounding line, the antenna pattern of radio frequency signals tends to concentrate in direction Z, and in consequence the antenna structure exhibits satisfactory directivity. Compared with the prior art, the present invention is advantageously characterized in that the magnetic flux of the antenna structure can be increased by swapping the position of the central grounding line with the position of a feed current, thereby allowing the antenna structure to exhibit satisfactory antenna matching. Therefore, the antenna structure of the present invention is adapted to not only receive and transmit a radio frequency signal with circular polarization but also increase the axial distance and thereby increase the bandwidth of the radio frequency signal, so as to augment the energy of the circularly polarized radio frequency signal received and transmitted by the antenna structure.

Although the present invention is disclosed above by an embodiment, the embodiment is not restrictive of the present invention. Any persons skilled in the art can make some changes and modifications to the embodiment without departing from the spirit and scope of the present invention. Accordingly, the legal protection for the present invention should be defined by the appended claims.

What is claimed is:

1. An antenna structure, comprising:

a central grounding line being linear and having two end portions provided with a grounding point and a first open point, respectively; and a spiral antenna having two end portions provided with a feeding point and a second open point, respectively, the spiral antenna winds around the central grounding line while extending in a direction from the grounding point to the first open point, with the second open point positioned proximate to the first open point, wherein the spiral antenna and the central grounding line are spaced apart by an axial distance, thereby allowing the antenna structure to receive and transmit a radio frequency signal with circular polarization;

wherein the grounding point connects with a system ground plane, wherein the antenna structure is adapted to receive a radio frequency signal from a radio frequency signal transmission unit via the feeding point of the spiral antenna only and enable the radio frequency signal to undergo resonance through a current path which begins at the feeding point and ends between the second open point and the first open point and thereby send the radio frequency signal with circular polarization, and the antenna structure connects to the system ground plane through the grounding point only.

2. The antenna structure of claim 1, wherein a total length of the central grounding line equals a quarter wavelength of the radio frequency signal with circular polarization.

3. The antenna structure of claim 1, wherein a total length of the spiral antenna equals a wavelength of the radio frequency signal with circular polarization.

4. The antenna structure of claim 1, wherein a distance between the grounding point and the first open point of the central grounding line substantially equals a distance between the feeding point and the second open point of the spiral antenna.

5. The antenna structure of claim 1, wherein a polarization direction of the radio frequency signal with circular polarization parallels to the central grounding line and extends from the grounding point to the first open point.

6. The antenna structure of claim 1, wherein the axial distance between the spiral antenna and the central grounding line is directly proportional to a Q-factor (Quality factor) of the radio frequency signal with circular polarization.

7. An antenna device, comprising:

a system ground plane;

a radio frequency signal transmission unit;

an antenna structure comprising;

a central grounding line being linear and having two end portions provided with a grounding point and a first open point, respectively, wherein the grounding point is connected to the system ground plane; and a spiral antenna having two end portions provided with a feeding point and a second open point, respectively, where the feeding point is connected to the radio frequency signal transmission unit, wherein the spiral antenna winds around the central grounding line while extending in a direction from the grounding point to the first open point, with the second open point positioned proximate to the first open point, wherein the spiral antenna and the central grounding line are spaced apart by an axial distance, thereby allowing the antenna structure to receive and transmit a radio frequency signal with circular polarization;

wherein the antenna structure receives a radio frequency signal from the radio frequency signal transmission unit via the feeding point of the spiral antenna only and enables the radio frequency signal to undergo resonance through a current path which begins at the feeding point and ends between the second open point and the first open point and thereby send the radio frequency signal with circular polarization; and wherein the antenna structure connects to the system ground plane through the grounding point only.

8. The antenna device of claim 7, wherein a total length of the central grounding line equals a quarter wavelength of the radio frequency signal with circular polarization.

9. The antenna device of claim 7, wherein a total length of the spiral antenna equals a wavelength of the radio frequency signal with circular polarization.

10. The antenna device of claim 7, wherein a distance between the grounding point and the first open point of the central grounding line substantially equals a distance between the feeding point and the second open point of the spiral antenna.

11. The antenna device of claim 7, wherein a polarization direction of the radio frequency signal with circular polarization parallels to the central grounding line and extends from the grounding point to the first open point.

12. The antenna device of claim 7, wherein the axial distance between the spiral antenna and the central grounding line is directly proportional to a Q-factor (Quality factor) of the radio frequency signal with circular polarization.

13. The antenna device of claim 7, wherein the antenna structure connects to the radio frequency signal transmission unit through the feeding point only, such that current from the radio frequency signal transmission unit is fed only to the feeding point during operation of the antenna device.

14. The antenna structure of claim 1, wherein the antenna structure connects to the radio frequency signal transmission unit through the feeding point only, such that current from the radio frequency signal transmission unit is fed only to the feeding point during operation of the antenna structure.

15. An antenna structure, comprising:

a central grounding line being linear and having two end portions provided with a grounding point and a first open point, respectively; and a spiral antenna having two end portions provided with a feeding point and a second open point, respectively, wherein the spiral antenna winds around the central grounding line while extending in a direction from the grounding point to the first open point, with the second open point positioned proximate to the first open point, wherein the spiral antenna and the central grounding line are spaced apart by an axial distance, thereby allowing the antenna structure to receive and transmit a radio frequency signal with circular polarization;

wherein the antenna structure is fed via the feeding point, not fed through the grounding point, and not differentially fed via both the feeding point and the grounding point.

* * * * *